US005149420A

United States Patent [19]

Buxbaum et al.

[11] Patent Number: 5,149,420

[45] Date of Patent: Sep. 22, 1992

[54] METHOD FOR PLATING PALLADIUM

[75] Inventors: Robert E. Buxbaum, East Lansing, Mich.; Peter C. Hsu, Overland Park, Kans.

[73] Assignee: Board of Trustees, operating Michigan State University, East Lansing, Mich.

[21] Appl. No.: 553,550

[22] Filed: Jul. 16, 1990

[51] Int. Cl.[5] ..... C25D 5/34

[52] U.S. Cl. ..... 205/219; 205/212; 205/265

[58] Field of Search ..... 204/32.1, 37.1, 47; 205/210, 212, 219, 265

[56] References Cited

U.S. PATENT DOCUMENTS

| | | | |
|---|---|---|---|
| 3,350,846 | 11/1967 | Makrides | 55/16 |
| 3,725,219 | 4/1973 | Wesoloski | 204/37.1 |
| 4,240,878 | 12/1980 | Carter | 204/37.1 |
| 4,486,274 | 12/1984 | Abys et al. | 204/47 |
| 4,715,935 | 12/1987 | Lovie et al. | 204/47 |
| 4,755,265 | 7/1988 | Young | 204/47 |

OTHER PUBLICATIONS

Boes, N., et al., Z. Naturforsch. 31 A, 754–759 (1976).

Pick, M. A., The Kinetics of Hydrogen Adsorption–desorption by Metals, G. Bombakidis ed. Proceeding of NATO Advanced Study Inst. on Metal Hydrides, Jun. 17–27, Rhodes, Greece (Plenum Press) pp. 329–343 (1981).

Hsu and Buxbaum, J. Electrochemical Soc. 132 2419–2420 (1985).

*Primary Examiner*—Donald R. Valentine
*Assistant Examiner*—Brian M. Bolam
*Attorney, Agent, or Firm*—Ian C. McLeod

[57] ABSTRACT

A method for plating palladium on Group IV-B and V-B metals, particularly niobium, vanadium, zirconium, titanium and tantalum as pure metals and as alloys is described. The method provides the metal to be plated with a roughened exposed surface to be plated which has been electrolytically hydrided and then the surface is plated using electroless or electrolytic plating. Hydride is removed from the plated surface, usually by heating. This also removes other surface impurities and aids the coat adhesion. The resulting palladium plated metal articles are usful for hydrogen extraction.

15 Claims, No Drawings

METHOD FOR PLATING PALLADIUM

BACKGROUND OF THE INVENTION (1) Field of the Invention

The present invention relates to a process for plating palladium on niobium, vanadium, zirconium, tantalum and titanium. In particular the present invention provides a very adherent plate of palladium on these metals in pure form or as alloys.

(2) Prior Art

Metal membrane hydrogen extractors have two main applications as developed for the nuclear and petroleum industries: economical hydrogen recovery and shifting the thermodynamics of otherwise unfavorable reactions. The main advantages of metallic membranes over polymers is that they generally accept higher temperatures and more corrosive environments. Also, the pressure drop for hydrogen recovery with metallic membranes can be much smaller than with polymeric membranes (as low as $10^{-8}$ torr for hydrogen recovery from liquid lithium) and the hydrogen is recovered at essentially 100% purity. These benefits can offset the generally higher fixed cost of metallic membranes.

Palladium and palladium alloys are the historic choice for metallic hydrogen extraction membranes. Their cost is high because of palladium's high cost-per-pound and low strength, but no other single metal combines palladium's high permeability and good surface properties. For many purposes, low cost composite membranes using palladium coated refractory metals appear to be as good or better than palladium. For example, a palladium coated zirconium or titanium membrane can be used for hydrogen extraction from a nuclear heat transfer fluid, for extraction and economical recovery of the hydrogen isotope.

In the past, gas sputtering has been used to coat palladium on various metals. Gas sputtering is inferior to electroless or electrolytic plating in providing a coating inside tubes, a preferred geometry for use for the purpose of hydrogen extraction. Until now, the only successful method reported for direct electroless or electrolytic plating of palladium on the refractory metals was a technique, reported below, for coating on zirconium.

U.S. Pat. No. 3,350,844 to Makrides et al discloses hydrogen separation using palladium on a group V-B metal (niobium, vanadium and tantalum). The palladium coating is accomplished by sputtering. Boes, N., et al, Z. Naturforsch. 31 A, 754–759 (1976) describes vapor deposition of palladium on vanadium or niobium. Pick, M. A., The Kinetics of Hydrogen Adsorption-Desorption by Metals, G. Bombakidis ed. Proceeding of NATO Advanced Study Inst. on Metal Hydrides, June 17-27, Rhodes, Greece (Plenum Press) pp. 329-343 (1981) also describes vapor deposition of palladium on niobium. Hsu and Buxbaum, *J. Electrochemical Soc.* 132 2419-2420 (1985) describes plating of palladium on zirconium using electroless plating. A zirconium hydride, deposited by chemical action to enhance the electroless plating, is described. Chemical hydriding produced poorly adherent coatings when applied to refractory substrates besides zirconium (i.e. Nb and V).

OBJECTS

It is an object of the present invention to provide a method for producing an adherent coating of palladium on metals selected from niobium, vanadium, tantalum, titanium and zirconium as pure metals and as alloys. It is further an object of the present invention to provide a process which is relatively simple to perform and which is economical. These and other objects will become increasingly apparent from the following description.

GENERAL DESCRIPTION

The present invention relates to a method for plating palladium on a metal selected from the group consisting of niobium, vanadium, tantalum, titanium and zirconium as pure metals and in alloys which comprises: providing the metal with a roughened and cleaned exposed surface to be plated; electrolytically hydriding the surface of the metal to be plated to form a layer of metal hydride; plating the hydrided surface of the metal with the palladium. Preferably the plated surface is then heated.

Further, the present invention relates to a plated article which comprises: a metal selected from the group consisting of niobium, vanadium, tantalum, titanium and zirconium as pure metals and alloys with a roughened exposed surface; and a palladium film plated on the roughened exposed surface of the metal, wherein the film has a thickness between about 0.02 and 20 micrometers and is adherent when heated to 200° C. in a vacuum wherein the metal had been electrolytically hydrided prior to being plated.

The metals which can be coated are in Groups IV-B and V-B, Periods 4 to 6 and include niobium (Nb), vanadium (V), tantalum (Ta), titanium (Ti) and zirconium (Zr). The pure metals or alloys can be plated. Examples of alloys which can be plated are Nb 1% Zr; VanStar TM; V 15 Cr 5Ti; and Nb 10% Hf 1% Ti. Other such alloys which can be plated will occur to those skilled in the art.

Surface oxides are removed from the metal and the surface is roughened by abrading. This step provides a surface which will accept an adherent plate. Various known roughening means can be used; however, steel wool is preferred for small surfaces which are accessible. With tubes, a rotating wire brush is used to abrade the inside of the tube.

A detergent can be used to clean the exposed surface. Ultrasound has been suggested to aid the detergent cleaning action. Acid etching can also be used to insure that the surface is clean. The acid etch can be accomplished with electrolysis (i.e. electropolishing) which is preferred.

Hydriding of the exposed surface is preferably accomplished electrolytically where the metal to be plated is the cathode. This step is very important to providing an adherent plate of palladium. Where the hydriding is done chemically the results are adherent where Zr was the refractory metal, but non-adherent on Nb and V. Thus, electrochemical hydriding is preferred for the range of refractory metals.

The plating of palladium is accomplished by electroless or electrolytic plating. Electroless plating is provided by electron donor reactions in a manner known to those skilled in the art. Electrolytic plating uses a separate battery to provide electromotive force to reduce the palladium. The palladium electroplating is accomplished at a pH between about pH 7 and 14 and current density of between about 0.005 and 0.5 amps per square centimeter on the exposed refractory metal surface.

The plating solutions are made using soluble palladium salts. These salts include palladium bromide, chloride, cyanide, fluoride, iodide, oxide hydrate, selenate or sulfate.

The plated object can then be treated to remove some remaining hydrogen, and increase the palladium adherence. This is done either prior to or in service. Hydrogen is preferably removed by heating to temperatures between about 150° and 300° C. at vacuum pressures. A final treatment involving heating the plated metal briefly to 300° to 750° C. can be advantageous for removal of impurities at the palladium refractory metal interface.

EXAMPLE 1

Palladium Baths

Procedure

The following process was used to coat palladium on niobium and vanadium:

1. Sample Machining

The samples, niobium and vanadium discs with surface area 8.5 $cm^2$, were machined from metal bars of purity of 99.8%.

2. Descaling

Steel wool polishing was used to remove surface scales and oxides and to roughen the surface. A steel wool whose roughness was about that of a "Brillo TM" pad was used.

3. Detergent Cleaning.

Ultrasonic detergent cleaning was used to remove surface oil and grease. The detergent used was "Alconox TM", although the brand is not thought to be important.

4. Water Rinse Using Double Distilled Deionized Water.

5. Anodic Acid Etching.

The sample was given an "acid etching" (Composition: HF 10%, $H_2O$, 90%. Anodic current density: 0.05 $A/cm^2$. Voltage: 3 V. The electrodes here and elsewhere were stainless steel in the shape of two flat plates with some (non-essential) holes (2"×2" (5 cm×5 cm)). Temperature: 22° C. Time: 1.5 min).

6. Another Water Rinse Was Given Using Double Distilled Deionized Water.

7. Cathodic Surface Hydriding

The sample was given a cathodic surface hydriding. (Composition: NaOH, 35 g/l; $Na_3PO_4$, 10 g/l. pH value: 14, preferaby between 13 and 15. Temperature: 22° C. Time: 30 seconds. Cathodic current density: 0.05 $A/cm^2$. Voltage: 4 V).

8. A Final Water Rinse Was Given Using Double Distilled Deionized Water.

9. The palladium plating was applied. The electroless palladium bath solution used was $PdCl_2$, 2 g/l; HCl (38%), 4 ml/l; $NH_4OH$ (28%), 160 ml/l; $NaH_2PO_2 \cdot H_2O$, 10 g/l. The temperature and the pH value were 50° C. and 9.8, respectively. Electroless plating was tried with and without the cathodic surface hydriding step in the surface pretreatment.

Results

The surface was hydrided for electroless plating of palladium on the niobium and vanadium. The surface hydride provides an improved surface for palladium deposition. Surface hydriding time of 30 seconds and a palladium plating time of 1 hour was enough to form an adherent palladium film of below 2 micrometers.

Adhesion was enhanced and evaluated via a heat-quenching procedure. The sample was heated in a vacuum oven to 200° C. at a rate of 30° C./hr, and was then immersed in room temperature water. No flaking, peeling, or blistering was observed. An adherent palladium coating film of below 2 micrometers can be obtained with method as can be seen from Table 1.

TABLE 1

| | Vanadium | Niobium |
|---|---|---|
| Acid etching at 22° C. for 90 seconds | etch off 2.0 μm | etched off 0.7 μm |
| Pd film thickness, at 50° C. for 1 hour | 1.3 μm | 1.5 μm |

EXAMPLE 2

Procedure

1. In this example the niobium or vanadium was in the form of a tube (inside diameter 1 cm; length 20 cm) and wall thickness 1 mm.

2. The outside surface of a tube to be plated was abraded with emery cloth and then steel wool. Steel brushes were used on the inside to remove surface oil and scale and to roughen the surface. Surface roughing was critical to maintaining the attachment of the new formed Pd coating—otherwise the coating tended to peel off during processing. Coarse, oil-free, steel wool was preferably used for the outside of tubes to be plated (its roughness was about that of a Brillo TM pad) and a steel wire brush on a drill was used for inside the tube.

3. The next step was detergent washing. This step removed some oil and debris remaining after the abrading step. An ultrasonic cleaning bath was used with a glass cleaning detergent solution. It is possible that a detergent solution could be used alone, without the ultrasonic activity.

4. The next step was a water rinse. Double distilled and deionized water was used.

5. The next step was electropolishing. This step removes residual scale remaining from the polishing step. The tube was made the anode, and a stainless steel rod with polymer spacers was used as a cathode inside the tube. A doubled length of stainless steel wire was used as an outside cathode. Thus, the inside and outside of the tubes were polished simultaneously. The composition of the electropolishing solution was 10% HF dissolved in double distilled deionized water with an applied potential of 1 Volt for vanadium and 3 V for niobium. Current densities were about 0.05 $A/cm^2$. Good cleaning of Nb resulted from 1 minute of electropolishing at 22° C. One and one-half (1.5) minutes of electropolishing produced somewhat poorer results for Nb, but good results were obtained for V. Plastic beakers and electropolishing vessels were used for this step.

6. The next step was a water rinse using double distilled deionized water.

7. The next step was cathodic surface hydriding. This step adds a layer of metal hydride at the surface, thus preparing the surface to accept a Pd coat. The solution contained 35 g/l NaOH, 10 g/l $Na_3PO_4$ in double distilled water. The potential was 4 V, temperature was 22° C., and the electrodes were the same as for the electropolishing step except that the tube was now the cathode and the stainless steel was now the anode. The current density was 0.05 $A/cm^2$. The pH was about pH 14, preferably between 13 and 15. Any solution of similar pH, conductivity and Debye length could be used. Experiments without a step of this sort, produced (non-adherent) plating.

8. The next step was rinsing with double distilled water.

9. The next step was Pd plating. The plating solution was $PdCl_2$ 2 g/l; HCl (38%) 4 ml/l; $NH_4OH$ (28%) 160 ml/l; $NaH_2PO_2.H_2O$ 10 g/l; admixed in double distilled water at a temperature of 50° C. The pH was 9.8, preferably between about pH 9 and 11. No electric current was applied since the phosphate oxidation reaction provided the electrons that reduced the Pd. Plating times of ½ to 2 hrs. produced good coating results. After 1 hr. there was a coat of 1.3 μm on V and 1.5 μm on Nb.

10. The final step was heating at 300° C. to remove surface impurities and hydride and to make the coat more adherent. The coating was adherent as evidenced by heating to 200° C. in vacuum and rapidly cooling in room temperature water.

Other redox reaction couples can work for producing the electroless deposition. A classic example is the formaldehyde-formic acid oxidation sometimes used in silvering mirrors. A variety of electrolytic or electroless solutions are possible candidates for the plating. For example, a solution of 5 g/l $PdCl_2$ and HCl (38%) 200 ml/l can be a suitable electroplating solution. This type of variation of plating bath formulation is known to those skilled in the art.

It is intended that the foregoing description be only illustrative of the present invention and that the present invention be limited only to the hereinafter appended claims.

We claim:

1. A method for plating palladium on a metal selected from the group consisting of niobium, vanadium and tantalum as pure metals and in alloys which comprises:

(a) providing the metal with a roughened and cleaned exposed surface to be plated;

(b) electrolytically hydriding the surface of the metal to be plated to form a metal hydride; and (c) plating the surface of the metal with the metal hydride with the palladium to form a coating.

2. The method of claim 1 wherein the plated surface is heated to remove surface impurities and hydride, and to make the coating more adherent.

3. The method of claim 1 wherein the surface with the metal hydride is plated in an aqueous solution containing a palladium salt by electroless or electrolytic plating so that palladium deposits on the surface.

4. The method of claim 3 wherein the surface of the metal to be plated is abraded with a steel wool or a wire brush to remove oxides and to roughen the surface.

5. The method of claim 4 wherein in addition the surface is cleaned by an acid etch.

6. The method of claim 5 wherein the acid is hydrofluoric acid.

7. The method of claim 6 wherein the metal is provided as the anode in an electrolytic cell during the etching.

8. The method of claim 2 wherein metal hydride is provided on the surface of the metal by providing the metal as the cathode in an electrolytic cell having a pH between about 13 and 15.

9. The method of claim 8 wherein a sodium hydroxide solution provides the pH.

10. The method of claim 8 wherein the solution has a pH between about 9 and 11.

11. The method of claim 10 wherein the palladium salt is selected from the group consisting of palladium bromide, chloride, cyanide, fluoride, iodide, nitrate, oxide hydrate, selenate or sulfate which provides palladium ions for the plating.

12. The method of claim 11 wherein the solution contains an inorganic or organic salt which provides electrons to reduce the palladium ions to palladium by electroless plating.

13. The method of claim 12 wherein the inorganic salt is sodium acid phosphate.

14. The method of claim 11 wherein the plating is accomplished electrolytically by providing the metal to be plated as the cathode in an electrolytic cell.

15. The method of claim 1 wherein the metal is selected from the group consisting of niobium and vanadium.

* * * * *